US008245694B2

(12) United States Patent
Kuhnke et al.

(10) Patent No.: US 8,245,694 B2
(45) Date of Patent: Aug. 21, 2012

(54) FUEL INJECTION SYSTEM WITH PRESSURE BOOSTING

(75) Inventors: Dominik Kuhnke, Stuttgart (DE); Dirk Vahle, Vaihingen A.D. Enz (DE)

(73) Assignee: Robert Bosch GmbH, Stuttgart (DE)

( * ) Notice: Subject to any disclaimer, the term of this patent is extended or adjusted under 35 U.S.C. 154(b) by 335 days.

(21) Appl. No.: 12/599,402

(22) PCT Filed: Apr. 14, 2008

(86) PCT No.: PCT/EP2008/054464

§ 371 (c)(1),
(2), (4) Date: Nov. 9, 2009

(87) PCT Pub. No.: WO2008/135339

PCT Pub. Date: Nov. 13, 2008

(65) Prior Publication Data

US 2010/0132667 A1 Jun. 3, 2010

(30) Foreign Application Priority Data

May 7, 2007 (DE) ..... 10 2007 021 327

(51) Int. Cl.
*F02M 37/00* (2006.01)

(52) U.S. Cl. ..... 123/447; 123/510; 123/511

(58) Field of Classification Search ..... 123/446, 123/447, 457, 458, 510, 511
See application file for complete search history.

(56) References Cited

U.S. PATENT DOCUMENTS

| | | | | |
|---|---|---|---|---|
| 3,059,433 | A * | 10/1962 | Hirsch | 60/565 |
| 4,142,497 | A * | 3/1979 | Long | 123/456 |
| 5,067,467 | A | 11/1991 | Hill et al. | |
| 5,622,152 | A * | 4/1997 | Ishida | 123/446 |
| 6,497,217 | B2 * | 12/2002 | Kojima | 123/456 |
| 6,499,448 | B2 * | 12/2002 | Yildirim et al. | 123/90.12 |
| 6,619,263 | B1 * | 9/2003 | Mahr et al. | 123/447 |
| 7,464,697 | B2 * | 12/2008 | Gray, Jr. | 123/456 |
| 7,726,283 | B2 * | 6/2010 | Vahle | 123/446 |
| 2005/0235962 | A1 | 10/2005 | Freisinger | |
| 2007/0039590 | A1 * | 2/2007 | Gray | 123/446 |
| 2007/0074703 | A1 | 4/2007 | Ibrahim | |

FOREIGN PATENT DOCUMENTS

| | | | |
|---|---|---|---|
| EP | 1754883 | A1 | 2/2007 |
| WO | 2004059160 | A1 | 7/2004 |

* cited by examiner

*Primary Examiner* — Thomas Moulis

(57) ABSTRACT

The invention relates to a fuel injection system for an internal combustion engine having a high pressure pump, a high pressure reservoir, a plurality of fuel injectors, a hydraulic pressure booster, and a control valve for actuating the hydraulic pressure booster. The hydraulic pressure booster is provided centrally for all of the fuel injectors. The central hydraulic pressure booster is disposed between the high pressure pump and the high pressure reservoir.

20 Claims, 2 Drawing Sheets

FUEL INJECTION SYSTEM WITH PRESSURE BOOSTING

CROSS-REFERENCE TO RELATED APPLICATION

This application is a 35 USC 371 application of PCT/EP2008/054464 filed on Apr. 14, 2008.

BACKGROUND OF THE INVENTION

1. Field of the Invention

The invention relates to a fuel injection system with pressure boosting for internal combustion engines.

2. Description of the Prior Art

A fuel injection system with pressure boosting, in which a central hydraulic pressure booster is provided for all the fuel injectors, is known from European Patent Disclosure EP 1 125 046 B1. The fuel pumped by means of a high-pressure pump is delivered to a central pressure reservoir (first common rail). The central pressure booster is connected downstream of the central pressure reservoir in the delivery direction of the fuel and delivers the pressure-boosted fuel to a further pressure reservoir (second common rail), from which a plurality of pressure lines corresponding to the number of injectors lead away the individual fuel injectors.

From European Patent Disclosure EP 1 123 463 B1, a further fuel injection system with pressure boosting is known. A central hydraulic pressure booster for all the fuel injectors is disposed in a bypass line parallel to a pressure line, which leads from the high-pressure pump to a distributor device, which in turn distributes the fuel to the various fuel injectors. However, the distributor device has no pressure storage function. The central pressure booster connected parallel is connected between the high-pressure pump and the distributor device.

A disadvantage of the pressure boosting systems is the high number of components needed as well as the relatively large control quantity for triggering the pressure booster. If for multiple injections of small injection quantities a boosted injection pressure is required, then the control chamber or differential pressure chamber of the pressure booster has to be relieved upon each injection. The result is a large control quantity that has to be diverted and that must accordingly be counted as a lost quantity in the injection system. Moreover, in terms of timing, multiple injections in the context of a cylinder stroke motion are possible only within a narrowly defined window, since each time the pressure booster is triggered, its differential pressure chamber has to refill with fuel. Moreover, with increasing injection pressures, the lost quantity increases in proportion to the fourth power across the gap width in the guide of the pressure booster piston, and this adversely affects the hydraulic efficiency of such fuel injectors.

OBJECT AND SUMMARY OF THE INVENTION

It is the object of the present invention to minimize not only the need for components and installation space but also the control quantity for triggering the pressure booster, in order to increase the efficiency of the pressure boosting of the fuel injection system.

The fuel injection system of the invention is optimized in terms of the need for installation space for individual system components. Because of a modular construction of the high-pressure pump, pressure booster, high-pressure reservoir and fuel injector, the fuel injection system of the invention can be used in all the known installation spaces of internal combustion engines, such as in the cylinder head region. Because of the disposition of the central hydraulic pressure booster between the high-pressure pump and the high-pressure reservoir (common rail), the central pressure booster has to be triggered only once per injection cycle of a fuel injector. As a result, the control quantity and leak fuel quantity are reduced considerably as a function of the number of injections. Because of this circumstance, the high-pressure pump can also be made smaller, since less fuel has to be pumped, since the number of refilling phases of the control chamber of the central hydraulic pressure booster is reduced considerably. The central pressure booster can as a result be designed in terms of its high-pressure delivery quantity for the maximum possible injection quantity of at least one fuel injector.

A compact installation space is advantageously attained if the central hydraulic pressure booster has a base body, in which a hydraulic storage chamber is embodied, and if the hydraulic storage chamber communicates hydraulically directly with the high-pressure pump via a pressure booster inlet. For that purpose, a high-pressure chamber and a control chamber are embodied in the base body, and a pressure booster piston is axially movably guided in it. The pressure booster piston acts on the high-pressure chamber for pressure boosting and on the control chamber for triggering the pressure booster. The hydraulic storage chamber is filled directly from the high-pressure pump. The volume of the hydraulic storage chamber should be designed such that the pressure drop is reduced, and the pressure fluctuations from the pump action are damped to an amount that is tolerable for the pressure boosting.

It is moreover provided that from the high-pressure chamber, a first hydraulic connection in the form of a high-pressure outlet leads to the high-pressure reservoir, and a second hydraulic connection leads into the hydraulic storage chamber; that the first hydraulic connection having the high-pressure outlet has a first cheek valve, and the second hydraulic connection has a check valve; and that the first check valve blocks a return flow from the high-pressure reservoir into the high-pressure chamber, and the second check valve blocks an inflow of the pressure boosted fuel from the high-pressure chamber into the hydraulic storage chamber.

The leak fuel losses that occur by way of the guide gaps, subjected to high pressure, at the pressure booster piston, can be reduced if the central hydraulic pressure booster, whose pressure booster piston is embodied with a first pressure booster piston part with a greater diameter $D_{21}$ and with a second pressure booster piston part with a lesser diameter $D_{22}$, is guided by at least one of the pressure booster piston parts in a piston guide body embodied on the base body. The piston guide body is surrounded at least partly by an annular chamber that is part of the hydraulic storage chamber. As a result, at least one pressure booster piston part is likewise surrounded by the pressure in the hydraulic storage chamber. By means of this provision, the guides of the pressure booster piston are subjected from outside at the instant of the pressure boosting to a supporting pressure, so that the guide play spreads less markedly because of the high internal pressure that prevails inside the high-pressure chamber. It is most expedient if the high-pressure chamber with its guide gap for the pressure booster piston is immediately adjacent the hydraulic storage chamber. As a result, the leak fuel loss from the high-pressure chamber into the hydraulic storage chamber, which is at medium pressure, is slight, since the medium pressure is the fuel pressure furnished by the high-pressure pump.

Expediently, the switching valve is associated with the central hydraulic pressure booster, but the switching valve can also be integrated with the base body. A filling line is also provided, which branches off from the hydraulic storage chamber and by way of which the control chamber and/or the high-pressure chamber is refilled after the pressure boosting phase.

At injection pressures below the maximum delivery pressure of the high-pressure pump, in the first switching position of the switching valve the pressure in the storage chamber is pumped by the high-pressure pump via the inlet onward through check valves via the high-pressure outlet to the high-pressure reservoir. From there, the fuel reaches the fuel injectors. During this operation, the central pressure booster is not triggered, so that the fuel pumped by the high-pressure pump reaches the high-pressure reservoir (common rail) in the bypass mode of the pressure booster.

If injection pressures are needed that are above the maximum delivery pressure of the high-pressure pump, the central pressure booster must be triggered. To that end, the switching valve, which is a 3/2-way valve, is put in a second switching position, being actuated electrically, hydraulically or pneumatically. In this second switching position, the control chamber of the pressure booster communicates for pressure relief with a pressure booster return via the switching valve.

BRIEF DESCRIPTION OF THE DRAWINGS

The invention will be described in further detail below in conjunction with the drawings, in which.

DESCRIPTION OF THE PREFERRED EMBODIMENT

Figure 1:
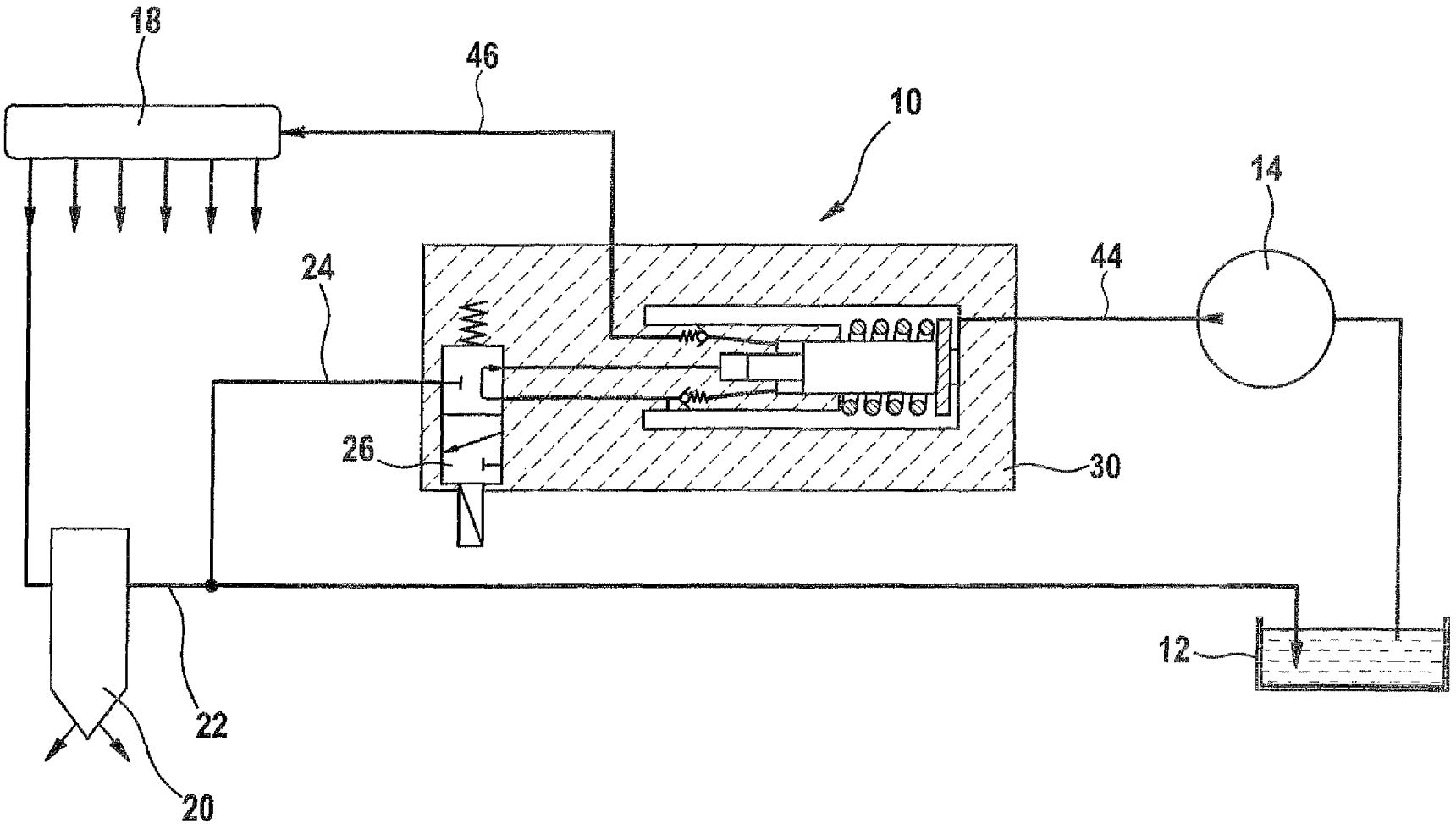
FIG. 1 shows a system layout of the fuel injection system proposed according to the invention.

The fuel injection system shown in FIG. 1 includes a fuel tank 12, from which fuel is pumped via a high-pressure pump 14 and delivered to a central hydraulic pressure booster 10. The central pressure booster 10 communicates on one side with the aforementioned high-pressure pump 14 via a pressure booster inlet 44, and on the other side, it acts on a high-pressure reservoir 18 (common rail). Connection lines to fuel injectors 20, the injectors being indicated only schematically in the view in FIG. 1, are located in the high-pressure reservoir 18 and correspond in number to the fuel injectors that are to be supplied with fuel at system pressure. On the combustion end of the fuel injectors, the fuel—represented by the arrows—at high pressure is injected into the combustion chamber of a self-igniting internal combustion engine. On the return side of the fuel injector 20 there is an injector return 22, into which a pressure booster return 24, which is connected to a switching valve 26, discharges. Both the pressure booster return 24 and the injector return 22 represent the low-pressure side of the fuel injection system as shown in FIG. 1, into which the diverted quantity, whether it is a control quantity or a leak fuel quantity, is pumped back into the fuel tank 12.

Dictated by the disposition of the central pressure booster 10 between the high-pressure pump 14 and the high-pressure reservoir 18, the pressure booster 10 has to be triggered by the switching valve 26 only once per injection cycle of a fuel injector 20. As a result, the control quantity or leak fuel quantity is reduced considerably as a function of the number of injections. The high-pressure pump 14 has less fuel to pump and can be made smaller. The pressure booster 10 should be designed in terms of its high-pressure delivery quantity for the maximum possible injection quantity of at least one of the fuel injectors 20.

Figure 2:
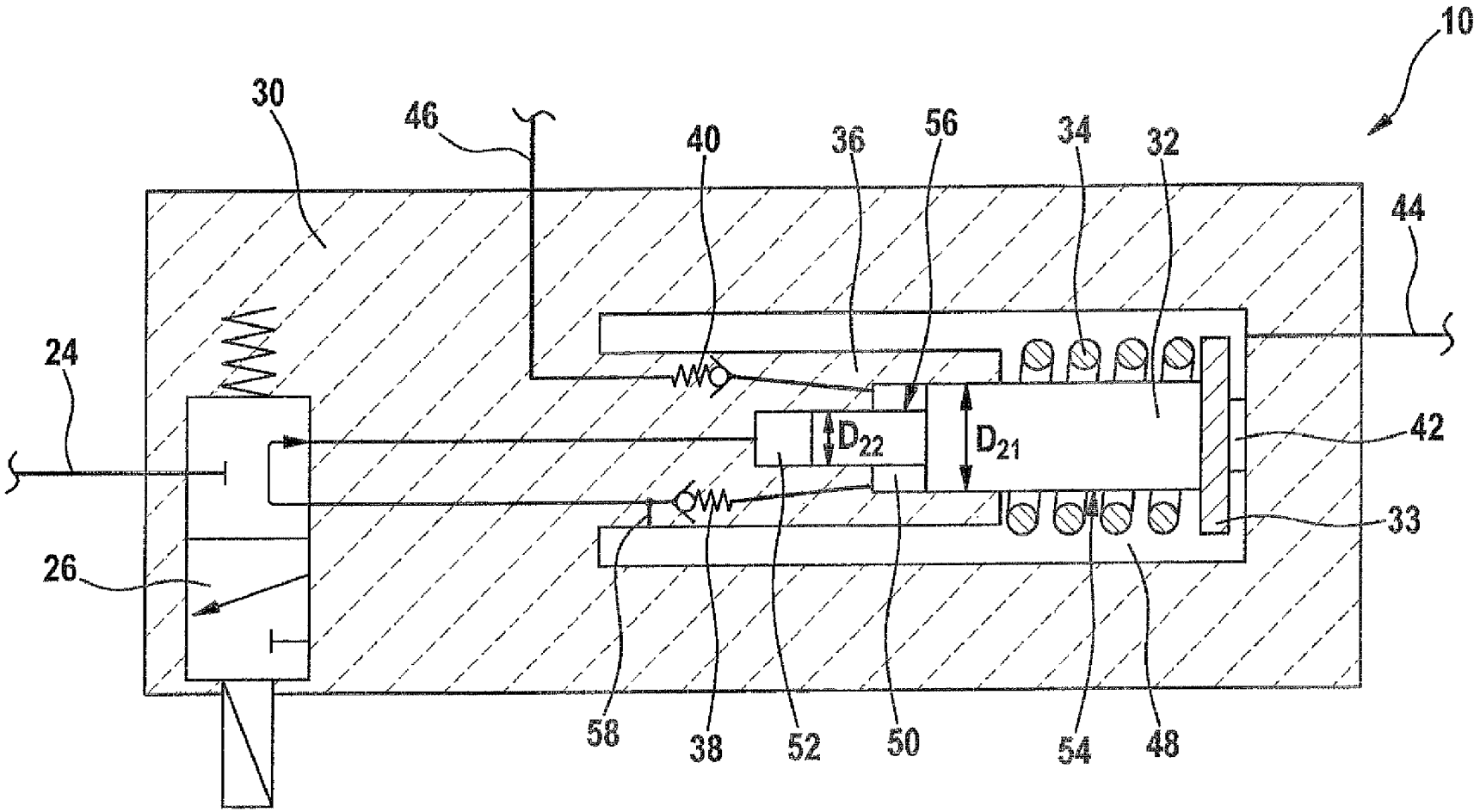
FIG. 2 shows a basic layout of a hydraulic pressure booster.

The central pressure booster 10 in FIG. 2 includes a base body 30, which may be constructed in one or multiple parts. A hydraulic storage chamber 48 is integrated with the base body 30. The hydraulic storage chamber 48 is subjected to fuel from the high-pressure pump 14 via the pressure booster inlet 44. The storage volume of the hydraulic storage chamber 48 is designed such that the pressure drop is reduced, and pressure fluctuations that result from the pump of the high-pressure pump 14 can be damped to an amount that is tolerable for the pressure boosting.

The central pressure booster 10 furthermore includes a pressure booster piston 32. It in turn includes a first piston portion with a first pressure booster piston part 54, designed with a diameter $D_{21}$, and a second piston portion with a second pressure booster piston part 56, designed with a diameter $D_{22}$. The pressure boosting ratio i of the pressure booster 16 in the basic sketch shown in FIG. 2 is as follows:

$$i=D_{21}^2/(D_{21}^2-D_{22}^2).$$

The central pressure booster 10 furthermore includes a high-pressure chamber 50 for pressure boosting as well as a control chamber 52 for triggering the pressure booster 10. The pressure booster piston 32 is exposed, with a second pressure face on the second pressure booster piston part 56 having the smaller diameter $D_{22}$, to the control chamber 52 and, with a first pressure face on the first pressure booster piston part 54 having the larger diameter $D_{21}$, to the high-pressure chamber 50.

The pressure booster piston 32 is acted upon by a restoring spring 34, which is braced on one end on the piston guide body 36 and on the other on a collar 33 embodied on the first pressure booster piston part 54. The pressure booster piston 32, the restoring spring 34, and the piston guide body 36 are in turn disposed in the storage chamber 48 in such a way that the storage chamber surrounds the piston guide body 36 in the region of the guidance of the pressure booster piston 32, expediently in the region of the first pressure booster piston part 54 that is embodied with the diameter $D_{21}$. By this provision, the guides of the pressure booster piston 32 are subjected to a support pressure from outside at the instant of the pressure boosting. This support pressure from outside causes the guide play, which is increased because of the pressure prevailing in the interior of the pressure booster 10, to widen less; otherwise, the result would be an unwanted outflow of guide leak fuel, which in turn would adversely affect the hydraulic efficiency of the pressure booster 10.

From the high-pressure chamber 50, a first hydraulic line branches off as a high-pressure outlet 46, which extends to the high-pressure reservoir 18 (common rail). A first check valve 40 is located in the high-pressure outlet 46. A second hydraulic line with a second check valve 38 also extends from the high-pressure chamber 50 and leads via a filling line 58 into the hydraulic storage chamber 48. The second check valve 38 acts here as a filling valve. The first check valve 40 blocks a reverse flow of fuel from the high-pressure reservoir 18 into the high-pressure chamber 50. The second check valve 38 blocks an inflow of the pressure-boosted fuel from the high-pressure chamber 50 into the hydraulic storage chamber 48. A further hydraulic line, which leads to the switching valve 26, branches off from the second hydraulic line. A further hydraulic line connects a further connection of the switching valve 26 to the control chamber 52. Via these hydraulic lines, the high-pressure chamber 50 and the control chamber 52 are refilled with fuel from the storage chamber 48, and the refilling of the control chamber 52 after its pressure relief upon actuation of the switching valve 26 also takes place via the filling line 58 from the storage chamber 48, via the further line in the switching position shown for the switching valve 26.

The restoring spring 34, which is disposed between the guide body 36 and a step on the pressure booster piston 32, presses the pressure booster piston 32 into its outset position, causing it to rest, with a stop limiter 42 provided on the end of the pressure booster piston, against the base body 30. The spring force of the restoring spring 34 is designed such that the pressure booster piston 32, after the pressure boosting, is brought back into the outset position on the stop limiter 42 at adequately high speed.

At injection pressures below the maximum delivery pressure of the high-pressure pump 14, in a first position of the switching valve 26 shown in FIGS. 1 and 2, the pressure of the high-pressure pump 14 is delivered via the pressure booster inlet 44 into the storage chamber 48 and from there onward, via the high-pressure valve embodied by the first check valve 40, to the high-pressure reservoir 18 via the high-pressure outlet 46. From the high-pressure reservoir, the fuel reaches the fuel injectors 20 that are to be supplied with fuel at system pressure. The fuel compressed by the high-pressure pump 14 thus directly reaches the high-pressure reservoir 18 (common rail) in the so-called bypass mode from the high-pressure pump 14; that is, in this operating mode, the pressure booster 10 is not active.

In order to attain injection pressures above the maximum delivery pressure of the high-pressure pump 14, the pressure booster 10 must be triggered. To that end, the switching valve 26 is put in the second switching position electrically, hydraulically or pneumatically. In the switching position of the switching valve 26, the control chamber 52 communicates with the pressure booster return 24. Fuel flows out of the pressure-relieved control chamber 52 via the switching valve 26 into the pressure booster return 24 and from there into the low-pressure region, shown in FIG. 1, of the fuel injection system back into the fuel tank 12. Because of the pressure reduction in the control chamber 52, the pressure booster piston 32 is moved axially counter to the spring force of the restoring spring 34, so that the first pressure booster piston part 54, embodied with the diameter $D_{21}$, presses into the high-pressure chamber 50 and increases the pressure there. The second check valve 38, in turn, is closed in the direction of the pressure booster return 24. If the pressure in the high-pressure chamber 50 rises above the pressure on the side of the high-pressure outlet 46, the compressed fuel is delivered by the high-pressure valve embodied by the first check valve 40 onward into the high-pressure reservoir 18 (common rail). Thus the high-pressure reservoir 18 is filled with the elevated pressure from the high-pressure chamber 50. From there, the fuel injectors 20 are then acted upon by the elevated fuel pressure, so that the injection via the fuel injectors takes place at the fuel pressure which is above the delivery pressure of the high-pressure pump 14. The pressure in the high-pressure chamber 50 rises until such time as a force equilibrium is reestablished at the pressure booster piston 32.

Upon deactivation of the switching valve 26, the control chamber 52 is again made to communicate hydraulically with the storage chamber 48. Because of this hydraulic connection, the pressure in the control chamber 52 rises, and the pressure booster piston 32 terminates the process of pressure boosting in accordance with the pressure boosting ratio i in the high-pressure chamber 50. Simultaneously, the first cheek valve 40 also closes, because of the prevailing pressure difference. Now, the spring force of the restoring spring 34 presses the pressure booster piston 32, with the stop limiter 42, against the base body 30 of the pressure booster 16. During this period of time, fuel is aspirated from the storage chamber 48 into the high-pressure chamber 50 via the check valve 38. Once the pressure booster piston 32 has reached the stop limiter 42, the switching valve 26 can be triggered for renewed pressure boosting.

The foregoing relates to the preferred exemplary embodiment of the invention, it being understood that other variants and embodiments thereof are possible within the spirit and scope of the invention, the latter being defined by the appended claims.

The invention claimed is:

1. A fuel injection system for an internal combustion engine, comprising:

a high-pressure pump;

a high-pressure reservoir;

a plurality of fuel injectors;

a central hydraulic pressure booster; and a switching valve for triggering the hydraulic pressure booster, the hydraulic pressure booster being provided for all the fuel injectors, wherein the central hydraulic pressure booster is disposed between the high-pressure pump and the high-pressure reservoir, wherein the central hydraulic pressure booster has a base body in which a hydraulic storage chamber is embodied, and the hydraulic storage chamber communicates hydraulically directly with the high-pressure pump via a pressure booster inlet, wherein there is only one line of communication between the hydraulic storage chamber and the high-pressure pump, and wherein fuel flows from the high-pressure pump to the hydraulic storage chamber without flowing through said switching valve.

2. The fuel injection system as defined by claim 1, wherein in the base body, a high-pressure chamber and a control chamber are embodied and a pressure booster piston is guided axially movably, and the pressure booster piston acts on the high-pressure chamber for pressure boosting and on the control chamber for triggering the pressure booster.

3. The fuel injection system as defined by claim 1, wherein from the high-pressure chamber, a first hydraulic connection, as a high-pressure outlet, leads to the high-pressure reservoir, and a second hydraulic connection leads into the hydraulic storage chamber, the first hydraulic connection having the high-pressure outlet has a first check valve, and the second hydraulic connection has a second check valve, and the first check valve blocks a return flow from the high-pressure reservoir into the high-pressure chamber, and the second check valve blocks an inflow of pressure boosted fuel from the high-pressure chamber into the hydraulic storage chamber.

4. The fuel injection system as defined by claim 2, wherein from the high-pressure chamber, a first hydraulic connection, as a high-pressure outlet, leads to the high-pressure reservoir, and a second hydraulic connection leads into the hydraulic storage chamber, the first hydraulic connection having the high-pressure outlet has a first check valve, and the second hydraulic connection has a second check valve, and the first check valve blocks a return flow from the high-pressure reservoir into the high-pressure chamber, and the second check valve blocks an inflow of pressure boosted fuel from the high-pressure chamber into the hydraulic storage chamber.

5. The fuel injection system as defined by claim 1, wherein the switching valve is associated with the central hydraulic pressure booster in the base body.

6. The fuel injection system as defined by claim 2, wherein the switching valve is associated with the central hydraulic pressure booster in the base body.

7. The fuel injection system as defined by claim 1, wherein the pressure booster piston is embodied with a first pressure booster piston part having a larger diameter and with a second pressure booster piston part with a smaller diameter, the base body has a piston guide body for at least one of the first pressure booster piston part and the second pressure booster piston part, and the piston guide body is surrounded at least partly by an annular chamber which is part of the hydraulic storage chamber.

8. The fuel injection system as defined by claim 2, wherein the pressure booster piston is embodied with a first pressure booster piston part having a larger diameter and with a second pressure booster piston part with a smaller diameter, the base body has a piston guide body for at least one of the first pressure booster piston part and the second pressure booster piston part, and the piston guide body is surrounded at least partly by an annular chamber which is part of the hydraulic storage chamber.

9. The fuel injection system as defined by claim 4, wherein the pressure booster piston is embodied with a first pressure booster piston part having a larger diameter and with a second pressure booster piston part with a smaller diameter, the base body has a piston guide body for at least one of the first pressure booster piston part and the second pressure booster piston part, and the piston guide body is surrounded at least partly by an annular chamber which is part of the hydraulic storage chamber.

10. The fuel injection system as defined by claim 1, wherein a filling line is provided, which branches off from the hydraulic storage chamber and by way of which the control chamber and/or the high-pressure chamber is refilled after a pressure boosting phase.

11. The fuel injection system as defined by claim 9, wherein a filling line is provided, which branches off from the hydraulic storage chamber and by way of which the control chamber and/or the high-pressure chamber is refilled after a pressure boosting phase.

12. The fuel injection system as defined by claim 1, wherein the pressure booster is inactive at pressures below a maximum delivery pressure of the high-pressure pump, and the maximum delivery pressure of the high-pressure pump acts upon the high-pressure reservoir via the hydraulic storage chamber, the check valves, and a high-pressure outlet.

13. The fuel injection system as defined by claim 2, wherein the pressure booster is inactive at pressures below a maximum delivery pressure of the high-pressure pump, and the maximum delivery pressure of the high-pressure pump acts upon the high-pressure reservoir via the hydraulic storage chamber, the check valves, and a high-pressure outlet.

14. The fuel injection system as defined by claim 11, wherein the pressure booster is inactive at pressures below a maximum delivery pressure of the high-pressure pump, and the maximum delivery pressure of the high-pressure pump acts upon the high-pressure reservoir via the hydraulic storage chamber, the check valves, and a high-pressure outlet.

15. The fuel injection system as defined by claim 1, wherein the pressure booster is activated when delivered pressures are above a maximum delivery pressure of the high-pressure pump, and its control chamber communicates for pressure relief with a pressure booster return via the switching valve.

16. The fuel injection system as defined by claim 2, wherein the pressure booster is activated when delivered pressures are above a maximum delivery pressure of the high-pressure pump, and its control chamber communicates for pressure relief with a pressure booster return via the switching valve.

17. The fuel injection system as defined by claim 14, wherein the pressure booster is activated when delivered pressures are above a maximum delivery pressure of the high-pressure pump, and its control chamber communicates for pressure relief with a pressure booster return via the switching valve.

18. A fuel injection system for an internal combustion engine, comprising:

a high-pressure pump;

a high-pressure reservoir;

a plurality of fuel injectors;

a central hydraulic pressure booster; and a switching valve for triggering the hydraulic pressure booster, the hydraulic pressure booster being provided for all the fuel injectors, wherein the central hydraulic pressure booster is disposed between the high-pressure pump and the high-pressure reservoir, wherein the central hydraulic pressure booster has a base body in which a hydraulic storage chamber is embodied, and the hydraulic storage chamber communicates hydraulically directly with the high-pressure pump via a pressure booster inlet, and wherein the pressure booster piston is embodied with a first pressure booster piston part having a larger diameter and with a second pressure booster piston part with a smaller diameter, the base body has a piston guide body for at least one of the first pressure booster piston part and the second pressure booster piston part, and the piston guide body is surrounded at least partly by an annular chamber which is part of the hydraulic storage chamber.

19. A fuel injection system for an internal combustion engine, comprising:

a high-pressure pump;

a high-pressure reservoir;

a plurality of fuel injectors;

a central hydraulic pressure booster; and a switching valve for triggering the hydraulic pressure booster, the hydraulic pressure booster being provided for all the fuel injectors, wherein the central hydraulic pressure booster is disposed between the high-pressure pump and the high-pressure reservoir, wherein the central hydraulic pressure booster has a base body in which a hydraulic storage chamber, a control chamber, and a high-pressure chamber are embodied, and the hydraulic storage chamber communicates hydraulically directly with the high-pressure pump via a pressure booster inlet, and wherein a filling line is provided, which branches off from the hydraulic storage chamber and by way of which the control chamber and/or the high-pressure chamber is refilled after a pressure boosting phase.

20. The fuel injection system as defined by claim 19, wherein in the base body a pressure booster piston is guided axially movably, and the pressure booster piston acts on the high-pressure chamber for pressure boosting and on the control chamber for triggering the pressure booster.

* * * * *